US007165344B2

(12) United States Patent
Blackwell

(10) Patent No.: US 7,165,344 B2
(45) Date of Patent: Jan. 23, 2007

(54) DISPOSABLE, ONE-PIECE, SELF-ADHESIVE, ALL-SURFACE, SPORT, GAME, PLAY, WORK, CUSHIONING, SAFETY "RED E" CLEAT

(76) Inventor: John Richard Blackwell, P.O. Box 871, Urbanna, VA (US) 23178

( * ) Notice: Subject to any disclaimer, the term of this patent is extended or adjusted under 35 U.S.C. 154(b) by 341 days.

(21) Appl. No.: 10/843,735

(22) Filed: May 12, 2004

(65) Prior Publication Data

US 2005/0252043 A1 Nov. 17, 2005

(51) Int. Cl.

| | |
|---|---|
| ***A43B 5/00*** | (2006.01) |
| ***A43B 13/22*** | (2006.01) |
| ***A43C 15/00*** | (2006.01) |
| *A43C 13/00* | (2006.01) |
| *A43B 23/00* | (2006.01) |

(52) U.S. Cl. ..... 36/134; 36/67 A; 36/67 D; 36/73

(58) Field of Classification Search ..... 36/134, 36/114, 132, 67 R, 67 A, 67 D, 59 C, 15, 36/136, 137, 73

See application file for complete search history.

(56) References Cited

U.S. PATENT DOCUMENTS

| | | | | |
|---|---|---|---|---|
| 1,524,997 | A * | 2/1925 | Potter | 36/59 B |
| 3,027,661 | A * | 4/1962 | McCord | 36/30 R |
| 3,561,140 | A * | 2/1971 | Ludwig | 36/59 R |
| 3,672,077 | A * | 6/1972 | Coles | 36/134 |
| 3,693,269 | A * | 9/1972 | Guarrera | 36/15 |
| 4,050,168 | A * | 9/1977 | Pace | 36/136 |
| 4,233,760 | A * | 11/1980 | Haynes | 36/137 |
| 5,293,701 | A * | 3/1994 | Sullivan | 36/59 R |
| 6,460,273 | B2 * | 10/2002 | Witjes | 36/71.5 |
| 6,863,033 | B1 * | 3/2005 | Fleming | 36/111 |
| 6,904,707 | B2 * | 6/2005 | McMullin | 36/127 |
| 2005/0274043 | A1 * | 12/2005 | DeSaix | 36/59 R |
| 2006/0005426 | A1 * | 1/2006 | Votolato | 36/7.3 |

* cited by examiner

*Primary Examiner*—Anthony Stashick

(57) ABSTRACT

A "RED e" cleat is a disposable, self-adhesive, all-surface footwear cleat having a non-skid gripping surface, designed to address all sport, game, play and work foot-traction requirements. The "RED e" cleat replaces the need for specialty footwear, which incorporates permanently implanted or attached devices for affixing traction gear to the underside of shoes. The cleats attach simply and quickly to the sole and heel area of any footwear. Removal of the cleat is also simple. By sliding a flat-edged tool between the cleat and the surface of the footwear to break the seal, the cleat will peel away leaving the footwear ready for other uses.

15 Claims, 4 Drawing Sheets

DISPOSABLE, ONE-PIECE, SELF-ADHESIVE, ALL-SURFACE, SPORT, GAME, PLAY, WORK, CUSHIONING, SAFETY "RED E" CLEAT

CROSS-REFERENCE TO RELATED APPLICATIONS

Not applicable.

BACKGROUND

1. Field of Invention

This invention relates to footwear traction and/or cushioning and safety cleats, specifically a disposable, one-piece, all-surface cleat with a self-adhesive back, which attaches quickly and easily to any footwear for sport, game, play or work, when additional foot traction, cushioning and/or reflective or light production benefits, are desired.

2. Description of Prior Art

The purpose for incorporating cleats into footwear has been primarily to enhance foot traction. Known cleats for sports and games utilize a male threaded post, hub, or other attaching device affixed to the top portion of the cleat. These cleats attach to footwear by screwing a male threaded post, hub, or attaching bayonet-style device into an implanted female base, or mounting device built into or attached permanently to the sole and heel areas of footwear. By design, this limits the footwear to a singular permanent use. As a result, this adds additional costs to the footwear, both to the manufacturer and to the consumer. Additionally, this renders the footwear useless for most other needs.

With the introduction of more modern manufacturing techniques, such as injecting and molding plastic resins, cleats today still attach in the same manner as before by screwing or attaching the cleat into a permanently mounted base in the sole and heel areas of the footwear. Additionally, cleats have had a singular purpose, and that is to add traction to footwear.

Cushioning, safety features, reflective or light production benefits, and advertising products and ideas as part of a cleat, have not been incorporated into known cleats, partially due to the restrictive size, shape and permanent nature of existing cleat designs along with traditional mounting placements. Cleats with a female threaded mounting device, or attaching bayonet-style device built into, permanently attached to the footwear, or molded into the sole and heel of footwear, limit variations in cleat shape and size by the existing restrictive size and required placement of the mounts to the footwear. Shapes such as square, oval, diamond, triangular, over-sized, unique, etc., are not adaptable to the restricted locations and attachment procedures necessary for these cleats.

Most commonly known cleats utilizing a male threaded post, hub or mounting device to attach the cleat to footwear have not included, by design, the additional advantage of marketing through tread, size, or uniquely shaped design, etc. Furthermore, cleats have been limited to addressing the requirements of sports and games, not exploring an expanded scope for uses in areas where dangerous surface conditions exist, such as slippery floors, icy areas, or any other locations where temporary non-skid traction for footwear would be useful. Additionally, these cleats consequently suffer from a number of additional disadvantages:

References Cited
U.S. Pat. Documents

| | | | |
|---|---|---|---|
| 6,647,647 | Nov. 18, 2003 | Auger, et al. | 36/134; |
| 6,543,160 | Apr. 18, 2003 | Price | 36/127; |
| 6,530,162 | Mar. 11, 2003 | Carroll | 36/134; |
| 6,519,879 | Feb. 18, 2003 | Gee | 36/134; |
| 6,338,208 | Jan. 15, 2002 | Waterbury | 36/134; |
| 6,481,122 | Nov. 19, 2002 | Brahler | 36/134; |
| 6,381,878 | May 7, 2002 | Kennedy, III, et al. | 36/134; |
| 6,327,797 | Dec. 11, 2001 | Deacon, et al. | 36/127; |
| 6,305,104 | Oct. 23, 2001 | McMullin | 36/127; |
| 6,209,230 | Apr. 3, 2001 | Curley, Jr. | 36/127; |
| 6,167,641 | Jan. 2, 2001 | McMullin | 36/127; |
| 6,115,974 | Sep. 12, 2000 | Swindle | 36/134; |
| 6,094,843 | Aug. 1, 2000 | Curley, Jr. | 36/127; |
| 6,052,923 | Apr. 25, 2000 | McMullin | 36/127; |
| 6,023,860 | Feb. 15, 2000 | McMullin | 36/127; |
| 6,009,640 | Jan. 4, 2000 | Deacon, et al. | 36/127; |
| 5,996,260 | Dec. 7, 1999 | MacNeill | 36/134; |
| 5,940,993 | Aug. 24, 1999 | Ronci | 36/134; |

(a) Known cleats have a single purpose by design, with permanent attachments that allow for replacing cleats on the sole and heel of footwear to enhance foot traction.

(b) Footwear made specifically for use in one sport or game such as golf, has by design only that one purposeful use.

(c) Known cleats address only foot traction; they are not disposable, one-piece, self-adhesive, all-surface, cushioning and/or heating, cooling and light production cleats designed to accommodate the needs of sports, games, play, work and safety conditions.

(d) Often cleats attach only to the brand of footwear for which they were manufactured. Most replacement cleats are not compatible with other brands of footwear, other sports or games, due mostly to the thread design of the post, hub or attaching device of the cleat.

(e) Benefits such as advertising, have not been widely incorporated into cleats for the use of manufacturers, retail outlets, companies, groups, individuals, etc., wishing to promote their company, products, ideas, etc.

(f) Footwear designed for sports or games such as golf, continues to rely on metal or plastic female threaded base mounts built into the soles and heels of footwear for attaching the male threaded post or hub of the cleat. This design limits the use of this footwear to a singular purpose. Additionally, permanently mounted clipon or bayonet style attachments suffer from the same limitations.

(g) Due to the use of permanently mounted bases for attaching cleats to the sole and heel areas of footwear, the shape of cleats has been mostly limited to a circular design, and the size is also limited to accommodate these mounting device locations on specialty footwear.

(h) Known plastic and metal cleats with male threaded posts require special tools to install and remove these cleats from footwear. This process can take several minutes to replace each cleat. To remove worn cleats, the assistance of experienced help is often required. Additionally, special tools such as a cleat tightening/extracting hand tool or a special cleat tightening/extracting drill bit for use with electric hand drills are required to remove and replace worn cleats.

(i) An individual attempting to participate in a sport or game without the footwear designed for that specific sport or game could suffer loss of foot traction. Loss of foot traction could affect performance and safety.

(l) Footwear designed and manufactured for a specific sport or game could cause discomfort for some. This discomfort could affect performance.

(k) Other needs for additional foot traction not addressed with the traditional type of cleat include, but are not limited to, unstable conditions due to ice and snow, slippery surfaces, all temporary needs for non-skid type footwear, as well as safety-related needs.

SUMMARY

In accordance with this invention, a "RED e" cleat is a disposable, one-piece, self-adhesive, all-surface, sport, game, play, work, cushioning and safety cleat. A "RED e" cleat attaches simply and quickly to the sole and heel areas of any footwear by removing the peel-off label from the self-adhesive surface of a desired cleat size, shape, design and purpose, and then by pressing the self-adhesive side of the "RED e" cleat to the desired location on the footwear. Removal of the cleat is also as simple. Peeling or scraping the cleat from the sole and heel of the footwear leaves the footwear ready for other uses. If desired, "RED e" cleats can be left on the footwear for a more extended use.

The disposable, one-piece, self-adhesive, all-surface, sport, game, play, work, cushioning, safety "RED e" cleat shall be hereafter referred to, unless for clarification the entire name is required in a specific paragraph in this U.S. patent application, as the/a "RED e" cleat.

The use of the term or name, "RED e" has been coined with this invention to denote the word, "ready". As ready/"RED e" is also a benefit of this invention, as in a ready/"RED e" cleat. Therefore, when the word, "RED e" is used in context, it denotes both the benefit as well as the name of this invention.

The use of the term, temporary, for this invention implies that a "RED e" cleat can be attached to any footwear, then removed after the desired use, and is not intended as a permanent part of the footwear.

In a preferred embodiment of a basic "RED e" cleat, the gripping surface is comprised of either opaque or transparent injected, molded, plastic resins. However, fabrication of this invention is not limited to an injecting, molding process, and can include but is not limited to, stamping, pressing, pouring, cutting and other forms of manufacturing techniques used separately or in combination with one or more materials. The gripping surface can consist of any material, and is not limited to polyethylene, polypropylene, thermoplastics, vinyl, nylon, rubber, leather, various impregnated or laminated fibrous materials, various plasticized materials, cardboard, or paper compounds, including recycled materials, etc.

Additionally, an embedded reflective pigment can also be molded into the gripping surface of a "RED e" cleat as a safety or advertising enhancement. In a transparent "RED e" cleat a layer of photo type paper, plastic, etc. can be incorporated. This photo type surface is for the purpose of tread design enhancement, background color, reflective benefits and/or advertising. The photo type paper, plastic, etc. is bonded between the molded transparent tread base and a layer of water-and-dirt-resistant adhesive bonding mixture. Additionally, several cleat designs can incorporate a layer of air, water, gel, other gases or liquids for cushioning the footwear. For added foot comfort, some "RED e" cleat designs can also incorporate a layer of chemicals for generating heat or cooling effects in footwear. Additionally, light production can also be achieved in a "RED e" cleat by incorporating light generating elements into a layer.

A combination of a selection of layers cohered through the use of an adhesive bonding mixture with the backside of the molded tread base form a one-piece "RED e" cleat. The back or outer surface of the bonding material forms the self-adhesive surface of the cleat. This self-adhesive surface bonds temporarily to the sole and heel areas of any footwear once a "RED e" cleat is pressed into place. A peel-off label covers the self-adhesive surface of a cleat until application to footwear.

Additionally, since a "RED e" cleat does not require the traditional male threaded post for mounting cleats to footwear, a "RED e" cleat is unrestricted as to a base design, shape, size or location on the sole and heel areas of footwear. Therefore, the user has the option of placing one or more of the "RED e" cleats on his/her footwear in whatever locations desired. The tread is also unlimited in design possibilities. These include, but are not limited to, size, shape, mirrored or reverse tread designs; reversed tread designs are for the purpose of imprinting the recognizable tread design on playing surfaces.

A variety of materials can be used in the manufacturing of a "RED e" cleat. For example, gripping or tread materials are selected and manufactured to accommodate terrains, surface conditions and uses. For indoor sports or games where different playing surfaces require varying degrees of foot traction, rubber, for example, or another non-skid material can comprise the gripping or tread surface of a "RED e" cleat in place of a more rigid, molded, plastic tread, which may be utilized in a "RED e" golf cleat.

Furthermore, with a "RED e" cleat, additional temporary foot traction addresses unstable conditions, such as caused by ice and/or snow, and applications where unsafe, slippery surfaces require non-skid footwear. Additionally, the "RED e" cleat can enhance foot comfort while standing on a hard surface such as concrete, with an added layer of air, water, gel or other gases, liquids or chemicals incorporated into a "RED e" cleat design. Reflective pigments can also be included in the material used for molding a "RED e" cleat. This feature adds a safety benefit of reflecting light, which is useful in dark situations. This reflective feature benefits emergency personnel, joggers, etc. Light producing elements incorporated into a layer of a "RED e" cleat for safety, entertainment, etc. also offer benefits after dark.

OBJECTS AND ADVANTAGES

Accordingly, several objects and advantages of the "RED e" cleat are:

(a) to provide a cleat/cleats which is/are a disposable, one-piece, self-adhesive, all-surface, sport, game, play, work, cushioning and safety cleat;

(b) to provide a cleat which includes use for, but is not limited to, such sports and games as golf, soccer, track and field, baseball, football, softball and hiking, along with all other sports and games where additional foot traction, cushioning, safety and/or foot lighting is desired;

(c) to provide a cleat for varying terrain, weather and slippery surface conditions which offers the option of a variety of tread surfaces, such as plastic or other gripping or tread surface components consisting of, but not limited to any flexible and/or non-skid material, polyethylene, polypropylene, thermoplastics, vinyl, nylon, rubber, leather, various impregnated or laminated fibrous materials, various plasticized materials, cardboard, or paper compounds, including recycled materials, etc.;

(d) to provide a cleat which includes use for, but is not limited to, foot traction for unstable conditions, such as caused by ice and snow;

(e) to provide a cleat which includes use for, but is not limited to, foot traction for applications where slippery surfaces require safety, non-skid footwear;

(f) to provide a cleat which includes use for, but is not limited to, foot traction as well as footwear cushioning, incorporating a layer of air, water, gel, other gases or liquids for cushioning, support, light production, heating and cooling comfort to footwear;

(g) to provide a cleat which includes a reflective pigment included within the material used in the molding of the tread, thus adding a safety benefit to this invention which can enable emergency personnel, such as firemen, or joggers running after dark, to be seen as light is reflected off the cleats;

(h) to provide a cleat which produces light for play, work and safety purposes;

(i) to provide a cleat which can be used as a replacement cleat for all brands of sport or game footwear, easily and quickly replacing cleats lost before or during play;

(j) to provide a cleat which can be easily and quickly removed after completion of a sport, game, work, play, or any other activity so that the same footwear can be used for more than one purpose;

(k) to provide a cleat which offers additional benefits to, but is not limited to, manufacturers, retail outlets, companies, groups, individuals, etc. wishing to promote their products or ideas;

(l) to provide a cleat which does not require any threaded, bayonet, clip-on, etc. base mounts permanently built in, or added to, the sole of the footwear for attaching cleats;

(m) to provide a cleat which offers the option of a variety of shapes of cleats as well as gripping or tread surfaces including, but not limited to: circular, square, oval, triangular, diamond, letters such as the letter e, any shape, word, word text, letter, number, size, novelty designs, words, slogans, as well as logo, marketing, trademark designs, etc.;

(n) to provide a cleat which offers the user the option of applying one or more large cleats to the sole or heel area of a shoe/shoes or as many smaller cleats as desired. This enhances the choices for tread design in areas such as size, shape, colors, etc. which benefits sports, games, work, play, safety, marketing, entertainment, personality, and other options;

(o) to provide a cleat which can be easily and quickly attached to any footwear for temporary or extended use to increase foot traction, cushioning and/or safety;

(p) to provide a cleat which does not require special talents or tools for attaching cleats to or removing cleats from any footwear;

(q) to provide a cleat which attaches to the sole and heel areas of any footwear by simply removing the peel-off label on the self-adhesive side of the cleat and then a pressing a cleat to the desired location on the sole or heel surface of the footwear;

(r) to provide a cleat which can be removed easily and quickly after use by simply peeling or scraping the cleat from the surface of the footwear; if desired, cleats can be left on the footwear for a more extended use;

(s) to provide a cleat which offers the choice of comfortable footwear to each individual based on his/her needs rather than a limited selection of footwear designed specifically for a particular sport, game, work or play;

(t) to provide a cleat with which anyone can participate in a sport, game, play or work requiring additional foot traction to enhance performance by wearing whatever comfortable footwear they happen to have; and (u) to provide a cleat which incorporates metal, plastic, or other materials as a spike, or spikes for use by the professional golfer.

Further objects and advantages are to provide a cleat which promotes options in tread design, size, shape, color, marketing, and safety along with additional foot traction and foot comfort. A "RED e" cleat can be used easily and without special tools or prior experience by anyone wishing to add temporary foot traction, cushioning, safety benefits and/or advertising to any footwear. Further objects and advantages will become apparent from a consideration of the ensuing description and drawings.

DRAWING FIGURES

Figure 1:
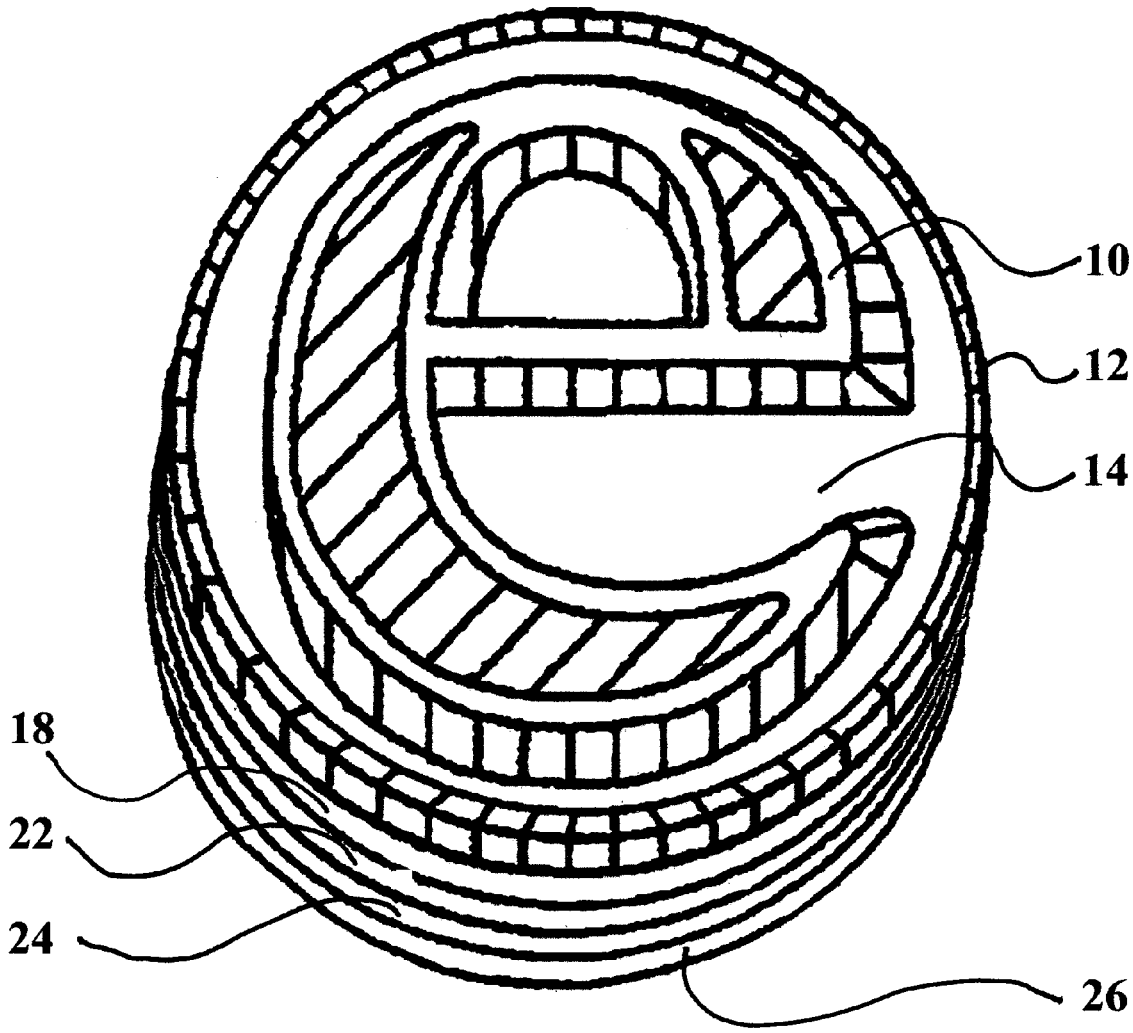
FIG. 1 is a top/side view of a circular-shaped cleat without a cushioning layer 20.

In the drawings, the assigned numbers represent part, or all of the corresponding layers, sections, or materials that combine into a disposable, one-piece, self-adhesive, sport, game, all-surface, play, work, cushioning, safety "RED e" cleat;

A raised center tread 10 can be one large tread, such as illustrated in FIG. 1, FIG. 2, FIG. 3 and FIG. 4, which can fill approximately 75% to 100% of the tread base 14 surface of a cleat. The raised center tread 10 can also be designed with a smaller repeated raised center tread 10 design, such as, but not limited to "eee" that fills approximately the same percentage tread base 14 area of the cleat. Additionally, a raised center tread 10 can incorporate multiple tread designs, such as, but not limited to "ReReRe" covering approximately the same percentage tread base 14 area of a cleat. These design examples do not limit this invention to those listed but include, and are not limited to, any letters such as the letter e, any shape, word, word text, letter, number, size, novelty designs, slogans, repeated designs, as well as logo, marketing, trademark designs, etc.

A raised center tread 10, a raised outer tread 12, a tread base 14, which includes supporting anchors 16 as part of the tread base 14, can consist of any material, including but not limited to polyethylene, polypropylene, thermoplastics, vinyl, nylon, rubber, leather, various impregnated or laminated fibrous materials, various plasticized materials, cardboard, or paper compounds, including recycled materials, etc. A cleat gripping or tread surface can be fabricated using any material separately or in combination with one or more other materials.

A cleat gripping or tread surface design can be fabricated using manufacturing techniques other than injected, molding, including but not limited to, stamping, pressing, pouring, cutting, etc. A cleat gripping or tread surface can also be fabricated using manufacturing methods in combination.

Supporting anchors 16, consisting of the same material used in the fabrication of a tread base 14, are molded simultaneously into the backside of the tread base 14. The supporting anchors 16 reinforce the bond between all layers, sections, materials and act as stabilizing units maintaining the position of the gripping layer to the other layers, sections and materials bonded together and to the footwear.

An enhancement layer 18 of photo type paper, plastic, etc. is not required in a cleat design using opaque materials. However, a design may require this layer with opaque materials when the reflective effect around the edge of a cleat base tread is part of the design, such as a separate safety reflector for emergency use.

Figure 2:
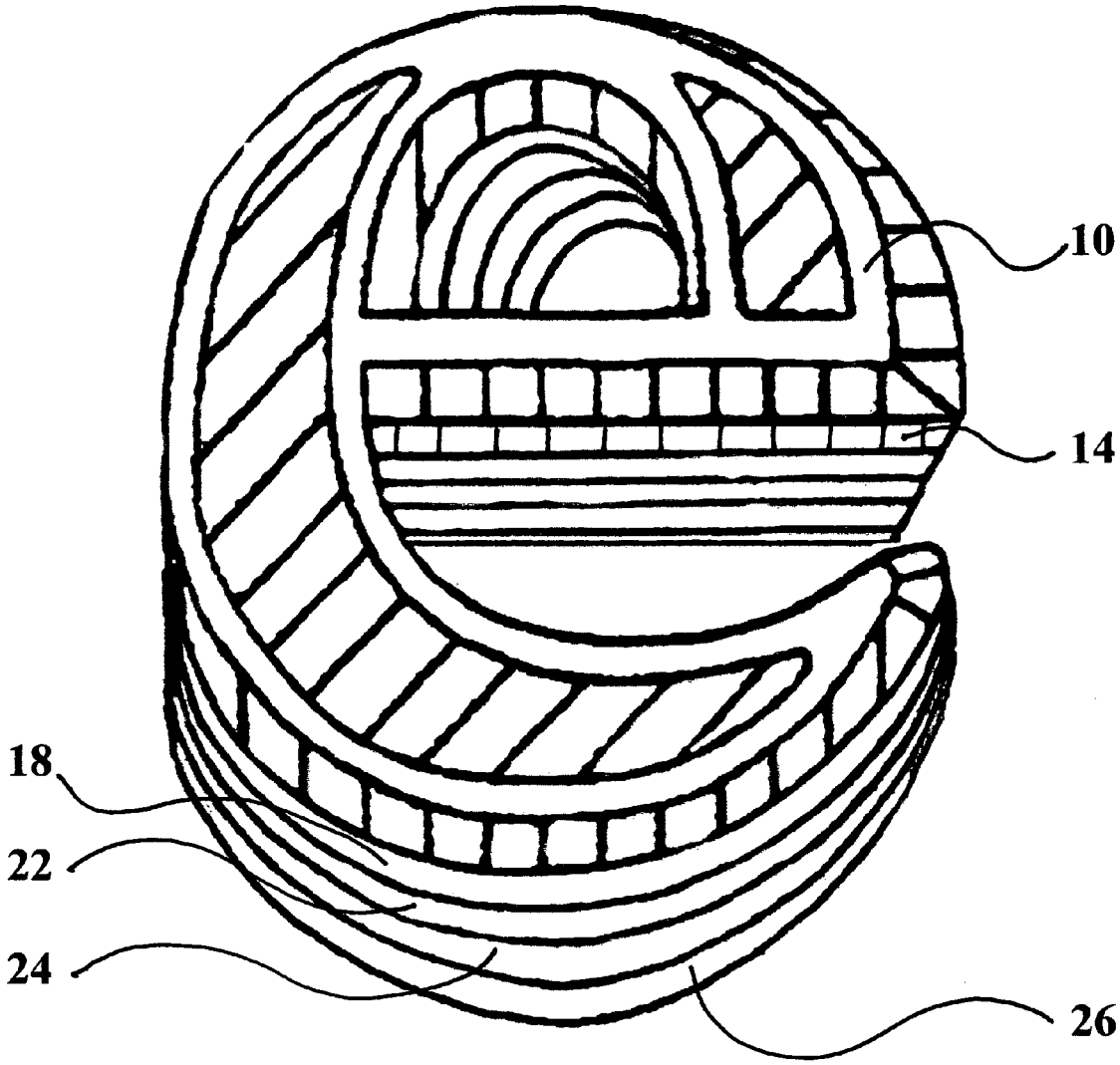
FIG. 2 is a top/side view of a design shape cleat without a cushioning layer 20.
Figure 3:
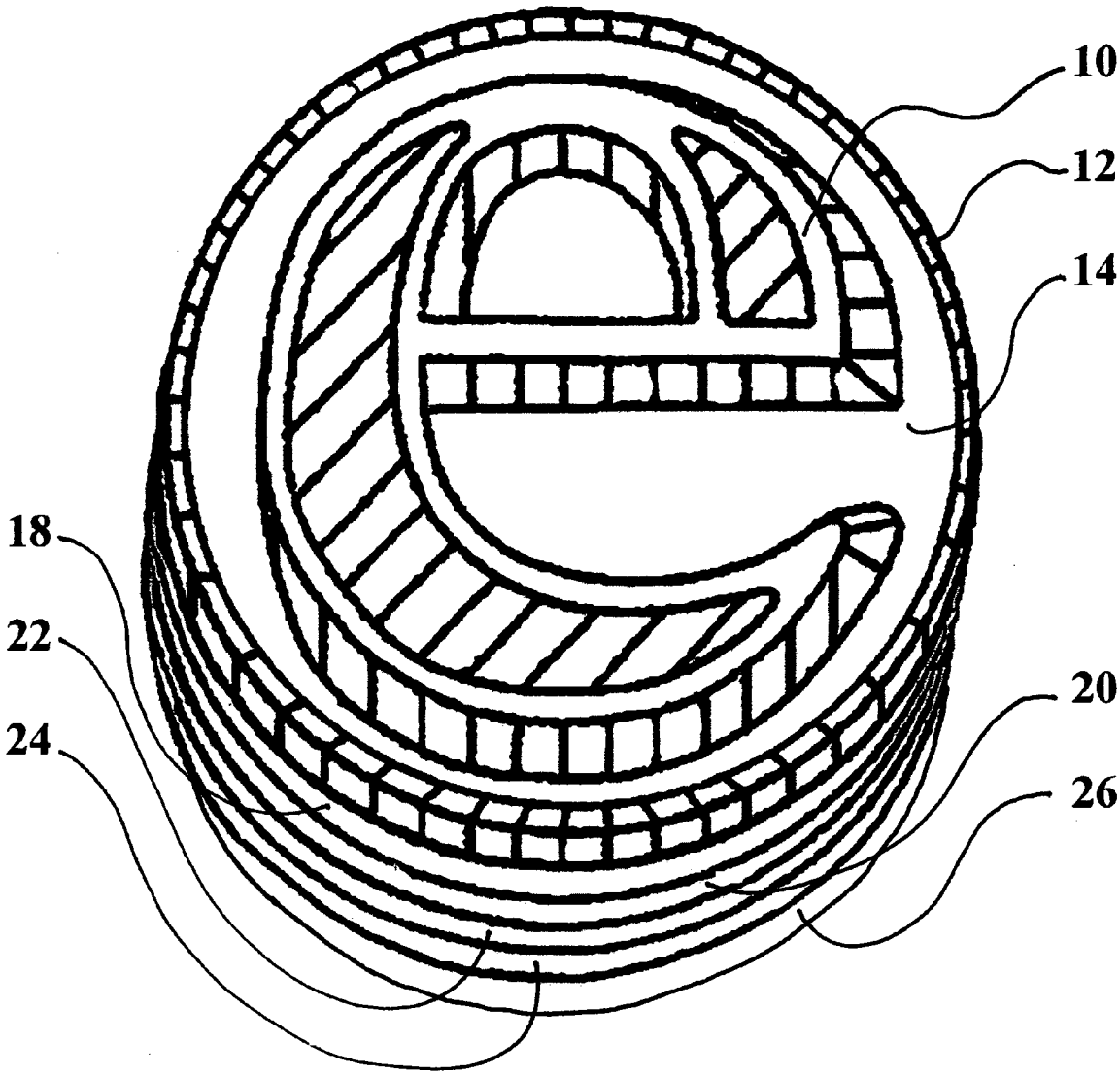
FIG. 3 is a top/side view of a circular-shaped cleat with a cushioning layer 20.

FIG. 1, FIG. 2, and FIG. 3 show a cleat as a whole unit with each layer, section, function or material in the drawings individually defined.

Figure 4:
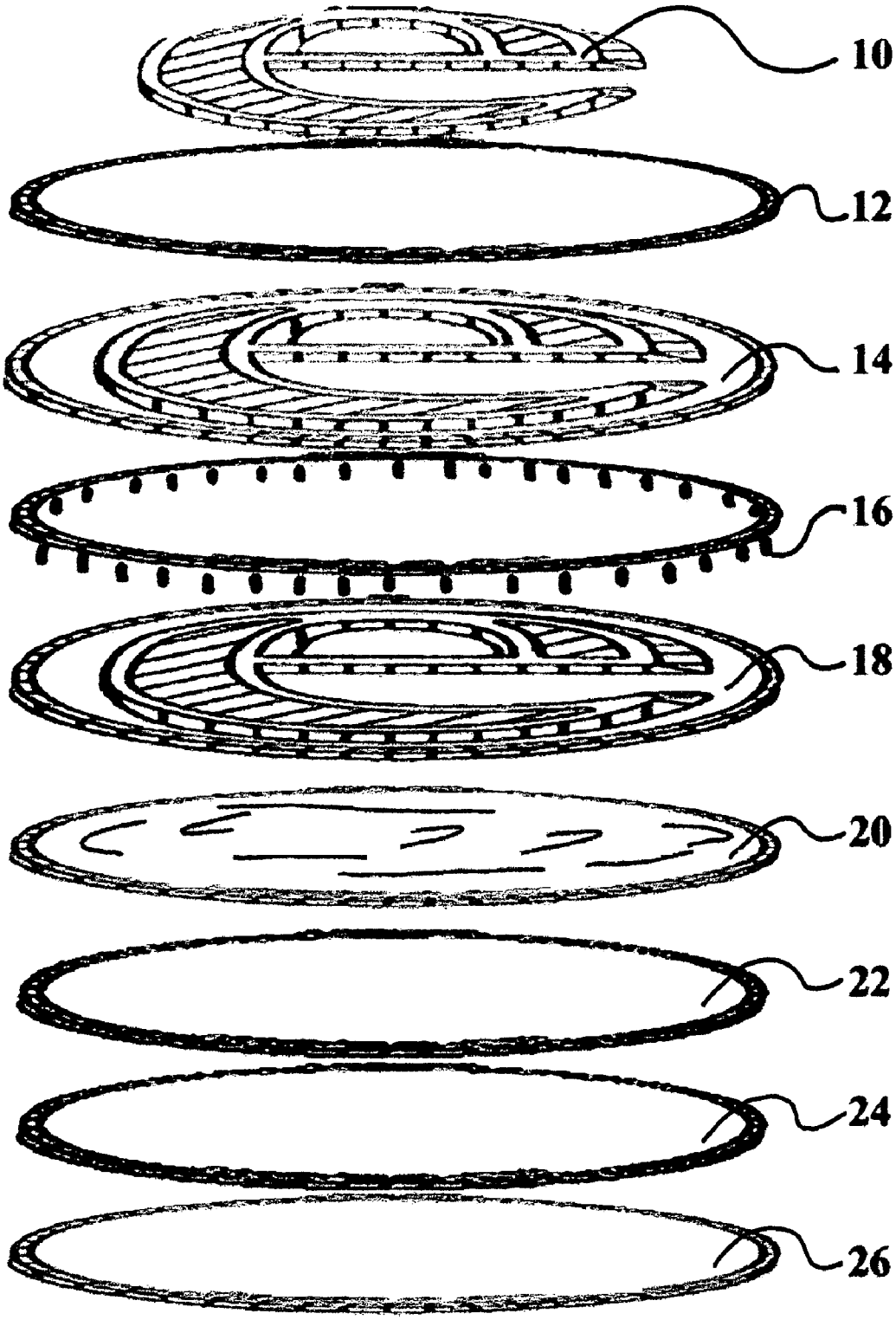
FIG. 4 is an exploded side view of a circular-shaped cleat with a cushioning layer 20 and illustrating the supporting anchors 16.

FIG. 4 shows an exploded cleat as a whole unit with each layer, section, function or material in the drawing individually defined.

In FIG. 1, FIG. 2, FIG. 3 and FIG. 4 the center tread design 10 is the letter e. This is an example of a center tread 10 design for a cleat, but this is not intended to limit the invention in part or whole, to a single shape, letter, size, image, novelty design, word, slogan, word text, repeated designs as well as logo, marketing, trademark design, etc.

In FIG. 1, FIG. 3 and FIG. 4 the raised outer tread 12 can be molded with one or more repeated raised outer tread 12 in a continuous, spaced or gapped edge for various design enhancements and traction needs.

FIG. 1, FIG. 3 and FIG. 4 illustrate a raised center tread 10, a raised outer tread 12, and a circular tread base 14. Each example can consist of any individual or combined shape and design incorporating one or more materials, consisting of but not limited to, polyethylene, polypropylene, thermoplastics, vinyl, nylon, rubber, leather, various impregnated or laminated fibrous materials, various plasticized materials, cardboard, or paper compounds, including recycled materials, etc., or combination thereof.

FIG. 3 and FIG. 4 show a cleat with the addition of a cushioning layer 20, consisting of air, water, gel, other gases or liquids, which when incorporated into the design of a cleat adds additional cushioning, and/or heating, cooling or light production advantage to a cleat.

FIG. 3 shows a cleat design, which by the stated dimensions, is intended to demonstrate the application of a single cleat accomplishing the task of adding foot traction and cushioning to any footwear. This example is not intended to limit this invention to a single shape, size, image, novelty design, word, slogan, word text, as well as logo, marketing, trademark design, etc.

FIG. 4 shows a cleat design with all layers exploded to illustrate the combination and relationships of all layers, sections, materials and functions of all or part of a cleat.

FIG. 1, FIG. 3 and FIG. 4 show a raised center tread 10 as part of a circular base tread design with a circular shape of the base tread 14 extending through all remaining layers, sections, or materials of a cleat. These examples show a circular design; this is not intended to limit this invention to a single shape, size, image, novelty design, word, slogan, word text, as well as logo, marketing, trademark design, etc. as part or all of a base tread 14 design.

FIG. 2 shows a cleat design as a singular raised center tread 10. This example of a designed shape demonstrates the use of the tread design through all layers, sections, or materials of a cleat. Additionally, a tread design can be one large design that fills most, or all of the surface of a cleat, a smaller repeated design, or multiple tread designs as well as any shape, letter, size, image, novelty design, word, slogan, word text, as well as logo, marketing, trademark design, etc., or combination thereof.

REFERENCE NUMERALS IN DRAWINGS

10 raised center tread of gripping layer, consisting of, but not limited to, an opaque or transparent, injected, molded, plastic material. A raised center tread 10 is molded or fabricated simultaneously to the topside of the tread base 14, and is part of a whole unit along with a raised outer tread 12, and the supporting anchors 16. However, fabrication of this invention is not limited to an injecting, molding process, and can include but is not limited to, stamping, pressing, pouring, cutting and other forms of manufacturing techniques used separately or in combination with one or more materials or manufacturing methods. A raised center tread 10 can consist of any flexible, non-skid material, and is not limited to polyethylene, polypropylene, thermoplastics, vinyl, nylon, rubber, leather, various impregnated or laminated fibrous materials, various plasticized materials, cardboard, or paper compounds, including recycled materials, etc. Additionally, a raised center tread 10 can be manufactured using any material separately or in combination with one or more other materials.

12 raised outer tread of gripping layer, consisting of, but not limited to an opaque or transparent, injected, molded, plastic material. A raised outer tread 12 is molded or fabricated simultaneously to the topside of the tread base 14, and is part of a whole unit along with a raised center tread 10, and the supporting anchors 16. However, fabrication of this invention is not limited to an injecting, molding process, and can include but is not limited to, stamping, pressing, pouring, cutting and other forms of manufacturing techniques used separately or in combination with one or more materials or manufacturing methods. A raised outer tread 12 can consist of any flexible, non-skid material, and is not limited to polyethylene, polypropylene, thermoplastics, vinyl, nylon, rubber, leather, various impregnated or laminated fibrous materials, various plasticized materials, cardboard, or paper compounds, including recycled materials, etc. and can be manufactured using any material separately or in combination with one or more other materials. Also, the raised outer treads 12 can be molded with one or more repeated raised outer tread 12 in a continuous, spaced or gapped edge for various design enhancements and traction needs and can be manufactured using any material separately or in combination with one or more other materials.

14 tread base of gripping layer, consisting of, but not limited to an opaque or transparent, injected, molded, plastic material. A tread base 14 is molded, or fabricated simultaneously as part of a whole unit along with a raised center 10, a raised outer tread 12, when applicable, and the supporting anchors 16. However, fabrication of this invention is not limited to an injected, molding process, and can include but is not limited to, stamping, pressing, pouring, cutting and other forms of manufacturing techniques used separately or in combination with one or more materials or manufacturing methods. A raised outer tread 12 can consist of any flexible, non-skid material, and is not limited to polyethylene, polypropylene, thermoplastics, vinyl, nylon, rubber, leather, various impregnated or laminated fibrous materials, various plasticized materials, cardboard, or paper compounds, including recycled materials, etc.

16 supporting anchor layer consisting of the same material, molded or fabricated simultaneously as part of a whole unit along with a raised center 10, a raised outer tread 12, when applicable, to the backside of the tread base 14. These supporting anchors reinforce the bond between all layers, sections, materials and act as stabilizing units maintaining the position of the gripping portion of a cleat to the other layers, sections and materials bonded together and to the footwear.

18 enhancement layer of photo type paper, plastic, etc., for the purpose of tread design enhancement, background color, reflective and safety benefits and/or advertising

20 cushioning layer of air, water, gel or other gas, liquid or chemicals for added cushioning, light production and/or heating or cooling

22 bonding adhesive layer

24 self-adhesive layer

26 peel-off label

DESCRIPTION

FIG. 1 and FIG. 2 Preferred Embodiment

A preferred embodiment of this invention is illustrated in FIG. 1, top/side view and FIG. 2, top/side view. In FIG. 1, a cleat shows a raised center tread 10 incorporating a chosen design consisting of a molded, plastic resin. FIG. 1 also incorporates a raised outer tread 12 consisting of a molded, plastic resin. FIG. 1 has a circular tread base 14 consisting of a molded, plastic resin, which incorporates supporting anchors 16, simultaneously molded into the backside of the tread base 14. These supporting anchors 16 reinforce the bond between all layers, sections, materials and act as stabilizing units maintaining the position of the gripping portion, center tread 10, outer tread 12, and tread base 14, to the other layers, sections and materials and to the footwear. Supporting anchors 16 are not shown in FIG. 1 and FIG. 2. A raised center tread 10, raised outer tread 12, tread base 14 and the supporting anchors 16 are fabricated as a single unit and form a gripping layer or section of a cleat.

When using a transparent material as demonstrated in FIG. 1 and FIG. 2, FIG. 3 and FIG. 4, an enhancement layer 18 of photo type paper, plastic, etc. is laminated below a tread base 14, covering the area in and around the supporting anchors 16, for enhancement of color, design, reflective qualities and/or advertising. A bonding cohesive layer 22 bonds all layers together and has a self-adhesive outer surface 24 that bonds a cleat temporarily to footwear. A peel-off label 26 seals the self-adhesive surface of a cleat until ready to attach to footwear.

An over-all depth of a cleat shown in FIG. 1 and FIG. 2 is approximately 5 mm to 7 mm in thickness, but is not limited to these dimensions. In FIG. 1 a diameter is represented as approximately 22 mm; however a diameter is not limited to a particular size or shape. A raised center tread 10 and a raised outer tread 12 are approximately 3 mm in depth above a tread base 14. A depth of tread base 14 is approximately 1 mm to 2 mm; however, these depths are not limited to these dimensions and can vary as necessary to suit a design. Supporting anchors 16, not shown in FIG. 1 and FIG. 2, extend downward from the backside of the tread base 14 and are spaced an average of 10 mm apart. Supporting anchors 16 are placed approximately 2 mm from the outside edge of the tread base 14 design, not exceeding more than 3 mm in toward the center of the tread base 14.

In FIG. 2, a cleat shows a raised center tread 10 incorporating a chosen design consisting of a molded, plastic resin. This tread design is an example of a designed shape and demonstrates the use of the center tread 10 design through all layers, sections, or materials of a cleat. In FIG. 2 a tread base 14 is identical to the raised center tread 10 and consists of a molded, plastic resin, which incorporates supporting anchors 16, simultaneously molded into the backside of the tread base 14. These supporting anchors 16, not shown in FIG. 2, reinforce the bond between all layers, sections, materials and act as stabilizing units maintaining the position of the gripping portion, 10 and 14, to the other layers, sections and materials and to the footwear. A raised center tread 10, tread base 14 and the supporting anchors 16 are fabricated as a single unit and form a gripping layer or section of a cleat. A raised outer tread 12 can be molded with a continuous, spaced or gapped edge. Additionally a raised outer tread 12 may be omitted as part of a center tread 10 designed cleat as is illustrated in FIG. 2.

When using a transparent material as demonstrated in FIG. 1, FIG. 2, FIG. 3 and FIG. 4, an enhancement layer 18 of photo type paper, plastic, etc. can be laminated below a tread base 14, covering the area in and around the supporting anchors 16, for enhancement of color, design, reflective qualities and/or advertising. A bonding cohesive layer 22 bonds all layers together and has a self-adhesive outer surface 24 that bonds a cleat temporarily to footwear. A peel-off label 26 seals the self-adhesive surface of a cleat until ready to attach to footwear.

An over-all depth of a cleat shown in FIG. 2 is approximately 5 mm to 7 mm in thickness, but is not limited to these dimensions. In FIG. 1 a diameter of a cleat is represented as approximately 7.5 cm; however a diameter is not limited to a particular size or shape. A raised center tread 10 is approximately 3 mm in depth above a tread base 14. A depth of tread base 14 is approximately 1 mm to 2 mm; however, these depths are not limited to these dimensions and can vary as necessary to suit a design. Supporting anchors 16, (not shown in FIG. 2) are spaced an average of 10 mm apart and are placed approximately 2 mm from the outside edge of the tread base 14 design, not exceeding more than 3 mm in toward the center of the tread base 14.

FIG. 3—Additional Embodiment

An additional embodiment is illustrated in FIG. 3 (top/side view). In FIG. 3, a cleat shows a raised center tread 10 incorporating a chosen design consisting of, but not limited to any flexible, non-skid material, such as polyethylene, polypropylene, thermoplastic, vinyl, nylon, rubber, leather, including recycled materials, etc. FIG. 3 incorporates a raised outer tread 12 typically consisting of a same material selected for the raised center tread 10. A circular tread base design 14 also typically consisting of the same materials used for a raised center tread 10 and a raised outer tread 12. Also in this embodiment, FIG. 3, a circular tread base 14 shape extends through all additional layers. However, flexibility, and/or foot cushioning, and foot traction when weather conditions such as ice or snow exist, as well as other environmental conditions and unsafe slippery surfaces, are important considerations of this design embodiment in FIG. 3. Therefore, a different material may be desired for a raised center tread 10, as well as for a raised outer tread 12 and a base tread 14, or any combination of materials thereof. A circular tread base 14 incorporates supporting anchors 16, (not shown in FIG. 3) simultaneously molded into the backside of the tread base 14. These supporting anchors 16 reinforce the bond between all layers, sections, materials and act as stabilizing units maintaining the position of the gripping portion, 10, 12, and 14, to the other layers, sections and materials and to the footwear. A raised center tread 10, raised outer tread 12, tread base 14 and the supporting anchors 16 are fabricated as a single unit and form a layer or section of a cleat.

When using a transparent material in FIG. 3, an enhancement layer 18 of photo type paper, plastic, etc., is bonded together with a tread base 14 covering the area in and around the supporting anchors 16, not shown in FIG. 3, for enhancement of color, design, reflective qualities and/or advertising.

FIG. 3 incorporates a cushioning layer 20 of air, water, gel, other gases, liquids or chemicals which when incorporated into the design of a cleat, adds additional cushioning and/or heating, cooling and light production advantages to a cleat. A bonding cohesive layer 22 bonds all layers together and has a self-adhesive outer surface 24 that bonds a cleat temporarily to footwear. A peel-off label 26 seals the self-adhesive surface of a cleat until ready to attach to footwear.

An over-all depth of a cleat shown in FIG. 3 is approximately 5 mm in thickness, but is not limited to this depth. In FIG. 3 a diameter is represented as approximately 7.5 cm; however a diameter is not limited to a particular size or shape. A raised center tread 10 and a raised outer tread 12 are approximately 3 mm in depth above a tread base 14. A depth of tread base 14 is approximately 1 mm to 2 mm; however, these depths are not limited to these dimensions and can vary as necessary to suit a design. A depth of a cushioning layer 20 is approximately 1 mm to 3 mm, but is not limited to this depth. The depth of a bonding adhesive layer 22 is approximately 1 mm to 3 mm, but is not limited to this depth. A depth of an self-adhesive layer 24 may vary as needed to supply a bonding surface to footwear as well as to enhance easy removal of a cleat from footwear. An enhancement layer 18 of photo type paper, plastic, etc., and a peel-off label 26 have an approximate depth of 0.025 mm or as a typical paper, but are not limited to these depths.

FIG. 3 shows a cleat design intended to demonstrate the application of one single cleat to accomplish adding foot traction, cushioning or light production to footwear, but this is not intended to limit this invention to a single shape, size, image, novelty design, word, slogan, word text, as well as logo, marketing, trademark design, etc.

FIG. 4 illustrates an exploded cleat drawing and shows a raised center tread 10 incorporating a chosen design consisting of, but not limited to any flexible, non-skid material, such as polyethylene, polypropylene, thermoplastic, vinyl, nylon, rubber, leather, including recycled materials, etc. FIG. 4 incorporates a raised outer tread layer 12 typically consisting of a same material selected for the raised center tread layer 10. A circular tread base layer 14 also typically consists of the same materials used for a raised center tread 10 and a raised outer tread 12. Also in this embodiment, FIG. 4, a circular tread base 14 shape extends through all additional layers. However, flexibility, and/or foot cushioning, foot traction when weather conditions such as ice or snow exist, as well as other environmental conditions and unsafe slippery surfaces, are important considerations of this design embodiment in FIG. 4. Therefore, a different material may be desired for a raised center tread 10, as well as for a raised outer tread 12 and a tread base 14, or any combination of materials thereof. A circular tread base 14 incorporates supporting anchors 16, simultaneously molded into the backside of the tread base 14. These supporting anchors 16 reinforce the bond between all layers, sections, materials and act as stabilizing units maintaining the position of the gripping portion, center tread 10, outer tread 12, and tread base 14, to the other layers, sections and materials and to the footwear. A raised center tread 10, raised outer tread 12, tread base 14 and the supporting anchors 16 are fabricated as a single unit and form a layer or section of a cleat.

When using a transparent material in FIG. 4, an enhancement layer 18 of photo type paper, plastic, etc. is bonded together with a tread base 14 covering the area in and around the supporting anchors 16, for enhancement of color, design, reflective qualities and/or advertising.

FIG. 4 incorporates a cushioning layer 20, of air, water, gel, other gases, liquids or chemicals which when incorporated into the design of a cleat adds additional cushioning and/or heating, cooling or light production advantages to a cleat. A bonding cohesive layer 22 bonds all layers together and has a self-adhesive outer surface 24 that bonds a cleat temporarily to footwear. A peel-off label 26 seals the self-adhesive surface of a cleat until ready to attach to footwear.

An over-all depth of a cleat shown in FIG. 4 is approximately 6 mm in thickness, but is not limited to this depth. In FIG. 4 a diameter is represented as approximately 7.5 cm; however a diameter is not limited to a particular size or shape. A raised center tread 10 and a raised outer tread 12 are approximately 3 mm in depth above a tread base 14. A depth of tread base 14 is approximately 1 mm to 2 mm; however, these depths are not limited to these dimensions and can vary as necessary to suit a design. A depth of a cushioning layer 20 is approximately 1 mm to 3 mm, but is not limited to this depth. The depth of a bonding adhesive layer 22 is approximately 1 mm to 3 mm, but is not limited to this depth. A depth of an self-adhesive layer 24 may vary as needed to supply a bonding surface to footwear as well as to enhance easy removal of a cleat from footwear. An enhancement layer 18 of photo type paper, plastic, etc., and a peel-off label 26 have an approximate depth of 0.025 mm or as typical paper, but are not limited to these depths.

Advantages

From the description above, a number of advantages of my "RED e" cleat become evident:

a. The flexibility of this invention in designs, uses, manufacturing techniques and materials increases the advantages in manufacturing costs, broad advertising and unlimited uses, as well as flexible price considerations.

b. This invention offers an endless variety of design and application possibilities to serve the traction, cushioning, safety and advertising needs for any and all uses.

c. A "RED e" cleat can be designed to address the demands of any sport, game, or other use and offers the convenience of easy application, as well as temporary use on any footwear for these purposes.

d. The need for specialty footwear to enhance foot traction and/or foot comfort while participating in a sport, game, work, play, or any other use will not be necessary for most people.

e. With a "RED e" cleat anyone can easily and quickly add additional traction, safety, cushioning and/or light production to any footwear.

f. The FIG. 3 embodiment of a cleat serves to highlight foot comfort enhanced with this invention. When standing or working on a non-resilient and/or slippery surface this invention can be easily attached to the sole and heel of any footwear. This offers the user cushioning and/or heating, cooling or light production with air, water, gel, other gases, liquids or chemicals incorporated into a layer of the "RED e" cleat.

g. The use of recycled or virgin materials in the production of the "RED e" cleat also enhances manufacturing cost considerations.

h. The choice of materials, for treads such as paper compounds, versus other longer-lasting materials will shorten the life of the tread but will add cost savings.

i. With a "RED e" cleat anyone can be ready in just a few minutes to engage in a sport or game, play, work and walk where additional traction and/or cushioning or foot light is required. Walk safely on slippery surfaces resulting from poor weather conditions such as ice and snow. Be seen after dark while working, jogging, playing, etc., or just add cushioning and/or heating or cooling to one's feet while standing on a non-resilient or hot/cold surface.

Operation—FIGS. 1, 2, 3, 4

The manner of using the "RED e" cleat to enhance foot traction, safety, provide cushioning or other foot comforts, is to attach one or more "RED e" cleats to the sole and heel areas of any footwear. First, remove all obstructions, such as dirt, grease, oil, grass, worn cleats, or any other debris, from the sole and heel areas of the ad hoc footwear. Next, by holding the gripping or tread surface of the "RED e" cleat so that the peel-off label 26, can be removed, peel the label off exposing the self-adhesive bonding surface 24 of a cleat. While holding the gripping or tread surface of the "RED e" cleat with the fingers of one hand, press the self-adhesive bonding surface 24 of a cleat to the desired location on the sole and/or heel of the footwear. Repeat this procedure for each additional "RED e" cleat desired. Once this process is completed, simply stand while wearing the footwear with one or more of the "RED e" cleats mounted in the desired locations on the footwear. By standing, additional pressure enhances the bond of the "RED e" cleats to the footwear. The "RED e" cleats are now ready to function with additional foot traction, safety and/or cushioning or light production for play or work.

To remove the "RED e" cleat simply peel or scrape the cleat from the surface of the footwear. The "RED e" cleat will peel away from the sole or heel leaving the footwear ready for other uses. Dispose of the used cleats. Additionally, with any of the uses for the "RED e cleat, " removal can be delayed to extend the use of the cleats.

CONCLUSION, RAMIFICATIONS, AND SCOPE

The reader will see that the "RED e" cleat can be attached to any footwear easily and conveniently and can be removed just as easily without the need for specialized tools or experience. In addition, with the "RED e" cleat there is little need to have specialty footwear for any function when additional foot traction, safety and/or cushioning is desired. Furthermore, the "RED e" cleat has the additional advantages in that it permits the production of cleats in a variety of tread designs, colors, materials, shapes and sizes to match the surface requirements, cost and marketing needs of those desiring added foot traction, advertising, safety and/or cushioning without the investment in specialty footwear;

it permits the convenience of having added foot traction in minutes under emergency conditions without the added cost of specialized footwear;

it permits participation in a sport, game, play, work or for any other use where additional foot traction, safety and/or cushioning enhances performance without the investment in specialty footwear;

it permits individuals to wear whatever footwear is most comfortable when additional foot traction, safety and/or cushioning is required without the investment in specialty footwear;

it permits light enhancement to any footwear for play, work and safety.

Although the description above contains many specificities, these should not be construed as limiting the scope of the invention but as merely providing illustrations of some of the presently preferred embodiments of this invention.

For example, the "RED e" cleat tread can be fabricated economically using a temporary compound combination, such as a polymer and paper with an advertising idea designed into the tread for promoting a special one-time event. On the other hand, the cleat tread could be constructed using a precious metal, stone, or other valuable material for commemorating a special event.

Thus, the scope of this invention should be determined by both the appended claims and their legal equivalents, along with any of the previous examples given.

What is claimed is:

1. A self-adhesive, disposable footwear cleat comprising:
a gripping layer consisting of a raised center tread and a tread base of any shape or design; and
a raised outer tread; and
an embedded reflective pigment; and
a supporting anchor layer; and
an enhancement layer; and
a light producing layer; and
a cushioning layer; and
a bonding adhesive layer; and
a self-adhesive layer; and
a peel-off label.

2. The cleat of claim 1 wherein a body is comprised of several layers or sections, a combination of layers bonded together to for n a disposable, self-adhesive, sport, game, all-service, play, work, cushioning and safety cleat designed for a specific purpose, or all-purpose uses.

3. The cleat of claim 1 wherein said gripping layer incorporates one or more components such as, but not limited to, any flexible and non-skid material, polyethylene, polypropylene, thermoplastic, vinyl, nylon, rubber, leather, various impregnated or laminated fibrous materials, various plasticized materials, cardboard, or paper compounds, including recycled materials.

4. The cleat of claim 1 wherein a body has said layer or layers of said bonding adhesive as necessary to cohere said layers together as a single unit, having a said self-adhesive outer surface which acts as a said attachment of said cleat to the sole and heel surface of any footwear.

5. The cleat of claim 1 wherein said self-adhesive layer is not restricted to a single bonding capability for all said cleats design purposes.

6. The cleat of claim 1 wherein said supporting anchor, layer, consisting of tread material molded or fabricated simultaneously to the backside of a tread base, which reinforces coherence between all said layers and acts as stabilizing units to maintain the position of said gripping layer to all other said layers bonded together.

7. The cleat of claim 1 wherein said gripping layer is comprised of a raised center tread design, this design extends through all additional said layers, said sections and said materials of said cleat.

8. An adaptable, disposable, self-adhesive, all-surface footwear cleat which enables any ad hoc footwear to be used temporarily for sports, games, play, work, or safety with the capability for inclusion of advertising comprising:

a selection of gripping layers for engaging all surfaces for sport, game, play, work, and safety which include platforms for advertising as all or part of the tread; and a reflective pigment molded into the gripping layer as an added safety benefit; and/or a reflective layer adding additional safety and advertising benefits; and a series of supporting anchors to stabilize all layers of cleat; and a cushioning layer for adding foot comfort benefits; and a bonding mixture which causes all layers, sections and materials to cohere; as well as a self-adhesive outer surface of the bonding material for adhesion to any footwear; and a peel-off label to protect the self-adhesive surface and provide additional marketing areas.

9. The cleat of claim 8 wherein a body has a gripping layer consisting of molded material.

10. The cleat of claim 8 wherein a body having a gripping layer consisting of any design.

11. The cleat of claim 8 wherein a body is unlimited in any chosen pattern, size and shape.

12. The cleat of claim 8 wherein body has a gripping layer, consisting of a raised center tread, fabricated of any colored opaque or transparent material, incorporating a readable design pattern, including a mirrored or reverse tread design for imprinting tread design into various playing surfaces for advertising uses and for foot traction.

13. The cleat of claim 8 wherein body has a reflective pigment incorporated into, or behind the gripping layer, or tread to enhance the design of the tread and add safety benefits to the cleat.

14. The cleat of claim 8 wherein said cleat tread or gripping area is unrestricted as to base design, shape, size or location on the sole and heel areas of footwear.

15. The cleat of claim 8 wherein said cleat incorporates one or more materials which address varying terrain or surface conditions for indoor and outdoor uses such as sports and games, work or play, and all weather conditions such as ice and snow, slippery work surfaces, daylight or night, safety or emergency uses.

* * * * *